US011192162B2

(12) United States Patent
Brüggenbrock et al.

(10) Patent No.: US 11,192,162 B2
(45) Date of Patent: Dec. 7, 2021

(54) METHOD AND DEVICE FOR FORMING A SEMI-FINISHED PRODUCT

(71) Applicants: ThyssenKrupp Steel Europe AG, Duisburg (DE); thyssenkrupp AG, Essen (DE)

(72) Inventors: Michael Brüggenbrock, Rosendahl (DE); Thomas Flehmig, Ratingen (DE); Lothar Hömig, Voerde (DE)

(73) Assignees: ThyssenKrupp Steel Europe AG, Duisburg (DE); thyssenkrupp AG, Essen (DE)

( * ) Notice: Subject to any disclaimer, the term of this patent is extended or adjusted under 35 U.S.C. 154(b) by 151 days.

(21) Appl. No.: 16/090,922

(22) PCT Filed: Mar. 30, 2017

(86) PCT No.: PCT/EP2017/057496

§ 371 (c)(1),
(2) Date: Oct. 3, 2018

(87) PCT Pub. No.: WO2017/174425

PCT Pub. Date: Oct. 12, 2017

(65) Prior Publication Data

US 2019/0105696 A1 Apr. 11, 2019

(30) Foreign Application Priority Data

Apr. 4, 2016 (DE) ..... 10 2016 205 492.9

(51) Int. Cl.

| | |
|---|---|
| ***B21D 19/14*** | (2006.01) |
| ***B21D 22/22*** | (2006.01) |
| ***B21D 22/26*** | (2006.01) |

(52) U.S. Cl.
CPC ..... *B21D 19/14* (2013.01); *B21D 22/22* (2013.01); *B21D 22/26* (2013.01)

(58) Field of Classification Search
CPC .... B21D 19/00; B21D 19/043; B21D 19/046; B21D 19/06; B21D 19/12; B21D 19/14;
(Continued)

(56) References Cited

U.S. PATENT DOCUMENTS 515,403 A * 2/1894 Marcy ..... B21K 1/30 72/356
1,944,527 A * 1/1934 Pfaendler ..... B21D 22/28 72/350

(Continued)

FOREIGN PATENT DOCUMENTS

CN 1817553 A 8/2006
CN 102729013 A 10/2012

(Continued)

OTHER PUBLICATIONS

Translation, JP 59-225830A, Komatsu, Dec. 1984.*
Translation; FR 2255976 A1, Daiwa, Jul. 1975.*
Translation; JP 2001-47175 A, Iwamura, Feb. 2001.*

*Primary Examiner* — Edward T Tolan
(74) *Attorney, Agent, or Firm* — The Webb Law Firm

(57) ABSTRACT

A method for forming a semi-finished product is disclosed, wherein the semi-finished product is provided in a provision step and, in a solid-stock forming step, a forming region of the semi-finished product is formed such that a thickness of the deformed forming region increases continuously toward one margin of the semi-finished product.

10 Claims, 27 Drawing Sheets

(58) Field of Classification Search
CPC ..... B21D 22/22; B21D 22/26; B21D 22/30; B21D 19/08; B21D 22/20; B21D 22/21; B21D 22/28
See application file for complete search history.

(56) References Cited

U.S. PATENT DOCUMENTS

| | | | | | |
|---|---|---|---|---|---|
| 2,958,115 | A * | 11/1960 | George | B21D 41/04 | 86/56 |
| 3,173,192 | A * | 3/1965 | Smith | F16C 33/543 | 29/898.065 |
| 4,441,354 | A * | 4/1984 | Bodega | B21D 51/24 | 72/342.1 |
| 5,129,146 | A | 7/1992 | Kanemitsu et al. | | |
| 5,806,358 | A * | 9/1998 | Rolf | B21D 22/16 | 72/110 |
| 5,987,952 | A * | 11/1999 | Kutzscher | B21D 22/16 | 29/894.362 |
| 6,484,401 | B1 * | 11/2002 | Specht | B21H 1/04 | 29/893.32 |
| 6,609,286 | B2 * | 8/2003 | Nakao | B21K 1/32 | 148/691 |
| 6,931,906 | B2 * | 8/2005 | Sorgi | B21K 21/12 | 280/504 |
| 7,797,976 | B2 * | 9/2010 | Friese | B21D 53/26 | 72/71 |
| 2004/0216505 | A1 | 11/2004 | Knaup | | |
| 2006/0125140 | A1 | 6/2006 | Saitou | | |
| 2007/0006628 | A1 * | 1/2007 | Tabei | B21K 1/30 | 72/348 |
| 2015/0089986 | A1 * | 4/2015 | Nillies | B21D 53/261 | 72/68 |
| 2015/0217357 | A1 * | 8/2015 | Tomaru | B21D 24/06 | 72/350 |
| 2015/0231688 | A1 | 8/2015 | Yamagata et al. | | |
| 2015/0360273 | A1 * | 12/2015 | Lin | B21D 24/04 | 72/311 |

FOREIGN PATENT DOCUMENTS

| | | | | | |
|---|---|---|---|---|---|
| CN | 104768671 | A | | 7/2015 | |
| CN | 104959442 | A | | 10/2015 | |
| DE | 3991692 | T1 | | 7/1991 | |
| DE | 69806887 | T2 | | 3/2003 | |
| DE | 10303184 | B3 | | 4/2004 | |
| DE | 102005059527 | A1 | | 6/2006 | |
| DE | 19957076 | B4 | | 10/2006 | |
| DE | 102006005964 | B3 | | 7/2007 | |
| EP | 0425704 | A1 | | 5/1991 | |
| EP | 0715908 | A2 | | 6/1996 | |
| FR | 2255976 | A1 | * | 7/1975 | B21D 35/006 |
| JP | 59-225830 | A | * | 12/1984 | B21D 22/22 |
| JP | 200147175 | A | | 2/2001 | |
| JP | 2010247199 | A | | 11/2010 | |

* cited by examiner

METHOD AND DEVICE FOR FORMING A SEMI-FINISHED PRODUCT

CROSS-REFERENCE TO RELATED APPLICATIONS

This application is the United States national phase of International Application No. PCT/EP2017/057496 filed Mar. 30, 2017, and claims priority to German Patent Application No. 10 2016 205 492.9 filed Apr. 4, 2016, the disclosures of which are hereby incorporated in their entirety by reference.

PRIOR ART

The present invention starts from a method for forming a semi-finished product, wherein the semi-finished product is provided in a provision step and is then deformed.

Such a method is known in the prior art.

For example, DE 698 06 887 T2 discloses a method for forming a semi-finished product, wherein the semi-finished product is formed such that a thickness of the deformed semi-finished product at first decreases abruptly and then increases abruptly toward one margin of the semi-finished product.

Furthermore, DE 39 91 692 T1 and DE 10 2006 005 964 B3 each disclose a method for forming a semi-finished product, wherein the semi-finished product is formed such that a thickness of the deformed semi-finished product increases abruptly toward one margin of the semi-finished product.

Furthermore, DE 199 57 076 B4 discloses a method for perforating and forming a semi-finished product, wherein the semi-finished product in one step of the method is perforated and formed such that a thickness of the perforated and deformed semi-finished product increases abruptly toward one margin of the semi-finished product.

The cold and hot forming of high-strength steels is a major contribution to lightweight steel construction. The process chain includes, beside the actual cold or hot forming and press hardening of the component, also at least a trimming of the component and a perforating, which in the case of high material strength is done with special tools or in a laser cell. In the case of mechanical trimming or perforations, the cut quality in regard to the cut surface is oftentimes poor.

The trimming and perforation processes known in the prior art usually have the drawback that edges of the cuts and perforations are sensitive to cracks or have poor resistance to crack formation and crack propagation. This is explained, for example, in that the edges of the cuts have microscopically tiny notches. It is especially disadvantageous that the fatigue strength of components with microscopically tiny notches is relatively low under oscillatory loading. Furthermore, it is a drawback for the trimming and perforation processes known in the prior art that, owing to a limited thickness of the metal sheets, screw or rivet connections based on perforations have a greatly limited resistance to being pulled out. Hence, only slight forces can be transmitted to attachment parts.

Problems of edge cracking also occur in multi-staged forming processes known in the prior art, especially when trimming is done in the meantime. Although a multi-staged (e.g., two-staged) trimming can produce better edge qualities, the preconsolidation may nevertheless have negative effects on the fatigue strength of the edges.

DISCLOSURE OF THE INVENTION

One problem which the present invention proposes to solve is to provide a simple and economical method for forming a semi-finished product, wherein the deformed semi-finished product has improved mechanical properties over the prior art.

This problem is solved in that, in a solid-stock forming step, a forming region of the semi-finished product is formed such that a thickness of the deformed forming region increases continuously toward one margin of the semi-finished product.

The method according to the invention for forming a semi-finished product has the advantage over the prior art that, thanks to the continuously increasing thickness of the deformed forming region toward the margin of the semi-finished product, the mechanical properties of the deformed semi-finished product can be adjusted in an especially targeted manner. In particular, with the method according to the invention it is advantageously possible to reduce the edge crack vulnerability of the deformed semi-finished product as compared to the prior art or to increase the resistance to crack formation and crack propagation of the semi-finished product as compared to the prior art. This is accomplished in particular because the forming region of the semi-finished product is deformed in the solid-stock forming step so that a cut surface or a surface resulting from a perforation is avoided at the margin.

Furthermore, it is advantageously possible with the method according to the invention to increase the load bearing ability of the deformed semi-finished product as compared to the prior art. This is accomplished in particular in that the thickness of the semi-finished product in the area of the deformed forming region can be adjusted specifically with the method according to the invention. In this way, in particular, it is advantageously possible to attune the thickness of the deformed forming region or a variation in thickness of the deformed forming region substantially parallel to a principal plane of extension of the semi-finished product to the stress distribution presumably occurring during use of a component produced with the aid of the present invention in the area of the margin.

Thus, with the method according to the invention the edge geometry and the edge configuration can be designed such that the edge crack vulnerability is lessened and the carrying capacity is increased by making use of specific material for perforation, notching and/or edging of structural parts or sheet blanks.

With the method according to the invention, the sheet metal thickness of the edges can be increased in the desired places during the fabrication of a structural part by local material accumulation at the outer or inner edges (recesses and/or holes) of the structural part or its sheet blank. The spatial extension of the thickening is directly dependent on the excess material provided and the shaping method.

In particular, a gradual dissipation of stresses generated at the margin of the structural part in use is made possible in that the material accumulation or the thickening or the deformed forming region is configured to be reduced progressively into the surface of the structural part or away from the margin and in the direction of the center of mass of the semi-finished product.

A further benefit of the method according to the invention is that thanks to the specifically deformed forming region a calibration of the structural part produced with the method according to the invention is made possible.

According to the invention, the semi-finished product preferably consists of a high-strength steel, especially preferably of a high-strength lightweight steel.

Preferably, the forming region comprises a partial region of the semi-finished product, preferably a margin region of the semi-finished product. Furthermore, the deformed forming region preferably comprises the forming region deformed by plastic deformation (solid-stock forming).

Furthermore, the thickness is preferably an elongation of the semi-finished product substantially perpendicular to a principal plane of extension of the semi-finished product. Moreover, the thickness of the provided semi-finished product is preferably substantially constant. Moreover, the thickness of a formed semi-finished product is substantially constant, wherein the thickness is preferably an elongation of the semi-finished product substantially perpendicular to a principal surface of extension. The principal surface of extension in the provided semi-finished product runs along the principal plane of extension and in the formed and deformed semi-finished product at least partly outside the principal plane of extension.

Moreover, the margin is preferably a boundary surface, especially preferably an edge, of the deformed semi-finished product. Preferably, the margin is formed straight, convex and/or concave curved in the principal plane of extension.

Preferably the method according to the invention is carried out within a method for the fabrication of high-strength structural components with edge and/or hole reinforcements.

Advantageous embodiments and modifications of the invention can be found in the dependent claims, as well as the description, making reference to the drawings.

According to one preferred embodiment of the present invention it is proposed that the semi-finished product is secured in a fixation step. This advantageously makes it possible for the semi-finished product not to slip during a step of the method following the fixation step and at the same time, if need be, the semi-finished product is formed only outside of a fixation region of the semi-finished product during a subsequent forming of the forming region of the semi-finished product.

According to one preferred embodiment of the present invention it is proposed that the fixation step is carried out at least partly at a time after the provision step, while the solid-stock forming step is carried out at least partly at a time after the fixation step. Thus, it advantageously becomes possible to at first form the semi-finished product and then to deform it.

According to one preferred embodiment of the present invention it is proposed that the solid-stock forming step and the fixation step are carried out at least partly at the same time. This advantageously makes it possible that the semi-finished product can be secured and formed substantially within a single step of the method. This enables a reduction of the fabrication time as compared to a consecutive performing of the securing and the solid-stock forming steps and thus enables an especially economical method.

According to one preferred embodiment of the present invention it is proposed that the semi-finished product is formed in a forming step. In this way, it is advantageously possible to form the semi-finished product prior to the deforming and thus to achieve more complex geometrical shapes of a deformed semi-finished product.

According to one preferred embodiment of the present invention it is proposed that the forming step is carried out at least partly at a time after the provision step, while the solid-stock forming step is carried out at least partly at a time after the forming step. This advantageously makes possible a forming and then a deforming of the provided semi-finished product.

According to one preferred embodiment of the present invention it is proposed that the forming step is carried out at least partly at a time after the fixation step, while the solid-stock forming step is carried out at least partly at a time after the forming step. This advantageously makes it possible that the semi-finished product can be at first secured, then formed, and after the forming to be directly deformed. This advantageously avoids a further step of the method or a renewed securing (renewed fixation step) for the formed semi-finished product and thus saves time in the fabrication process.

According to one preferred embodiment of the present invention it is proposed that the fixation step and the forming step are carried out at least partly at the same time. This advantageously makes it possible that the semi-finished product can be secured and formed substantially within a single step of the method. This makes possible a reduction of the fabrication time as compared to a consecutive performing of the securing and forming steps and thus enables an especially economical method.

According to one preferred embodiment of the present invention it is proposed that the semi-finished product, preferably a fixation region of the formed semi-finished product, is secured in a renewed fixation step. Especially preferably, it is proposed that the renewed fixation step is carried out at a time after the forming step and at a time before the solid-stock forming step. The renewed fixation step advantageously makes it possible for the semi-finished product to be at least partly secured for the solid-stock forming step and thus only the forming region of the semi-finished product is deformed in the solid-stock forming step. This makes possible a plastic deforming of the forming region, without producing mechanical stresses during the solid-stock forming step resulting in a plastic deformation of the fixation region in the fixation region of the semi-finished product or introducing such stresses into the fixation region. Hence, the method according to the invention is especially advantageous as compared to the multistaged fabrication methods known in the prior art for components free of edge trimming, in which a minimum shape blank is provided, which contains a material reserve by way of additional length portions in all cross section areas and which is subjected to a compressive stress over the entire sheet blank, resulting in a slight material thickening at the flat areas of the component so produced.

According to one preferred embodiment of the present invention it is proposed that a compressive stress superimposing created in the solid-stock forming step is utilized for the calibration of the deformed semi-finished product and the rebounding of the structural part is minimized.

According to one preferred embodiment of the present invention it is proposed that the forming region of the semi-finished product is deformed in the solid-stock forming step such that the center of mass of the forming region after the solid-stock forming step is situated further in the direction of the margin than before the solid-stock forming step. This advantageously makes possible a redistribution of material of the semi-finished product from the interior of the semi-finished product toward the margin or edge.

According to one preferred embodiment of the present invention it is proposed that the forming region of the semi-finished product is deformed in the solid-stock forming step such that the center of mass of the forming region is situated further in the direction of the margin prior to the solid-stock forming step than after the solid-stock forming step. Thus, in advantageous manner, a redistribution of the material of the semi-finished product from a cut edge or from a drop-off region and toward the interior of the semi-finished product becomes possible.

According to one preferred embodiment of the present invention it is proposed that the solid-stock forming step involves a cold forming step, a warm forming step, or a hot forming step. This advantageously makes it possible that the semi-finished product can be deformed by means of cold forming, warm forming or hot forming and thus the mechanical properties of a structural part fabricated from the semi-finished product can be specifically influenced. Especially in the case of hot forming, the flow of the material prior to the hardening exhibits a greater internal homogeneity, since the method according to the invention includes at least partly a solid-stock forming. Preferably, it is also provided that the hot forming step comprises a tailored tempering step. Thanks to the combination of hot forming and tailored tempering it is advantageously possible that the solid-stock formed material can be not primarily hardened but instead recrystallization annealed at the edge or at the margin. Thus, for example, it is also proposed that the solid-stock forming step involves a recrystallization annealing step, wherein the semi-finished product, preferably the deformed forming region, is at least partly recrystallization annealed.

According to one preferred embodiment of the present invention it is proposed that the formed semi-finished product is removed from the device, preferably at a time after the forming step. According to a preferred embodiment of the present invention, it is proposed that the deformed semi-finished product is removed from the device preferably at a time after the solid-stock forming step.

A further subject matter of the present invention is a device for forming a semi-finished product, especially as by a method according to the invention, wherein the device comprises a molding tool, wherein the molding tool is designed such that a forming region of the semi-finished product can be deformed such that a thickness of the deformed forming region increases continuously toward one margin of the semi-finished product. The benefits of the method according to the invention also apply accordingly for the device according to the invention.

According to one preferred embodiment of the present invention it is proposed that the molding tool comprises a first molding tool punch and a second molding tool punch. Preferably, the first molding tool punch and the second molding tool punch are designed such that the geometrical shape or a spatial extension of the deformed forming region can be determined. Especially preferably, it is proposed that the first molding tool punch and the second molding tool punch are designed such that the spatial arrangement of the deformed forming region can be determined relative to a non-deformed region of the semi-finished product. In other words, it is preferably proposed that the thickening side can be selected by the design of the molding tools (inside/outside/middle).

According to one preferred embodiment of the present invention it is proposed that the device comprises a fixation tool, wherein the fixation tool is designed such that the semi-finished product can be secured.

A further benefit of the method according to the invention and the device according to the invention is that the stiffness of the structural part fabricated from the semi-finished product and especially of course the edge in particular is enhanced. A further benefit is that the specifically deformed forming region or the thickening makes possible the application of further shaping methods, such as thread forming or edge widening. Additional positive effects also result from the avoidance of edge crack vulnerability. For example, this enhances both the fatigue strength of the structural part and the drawability of deep-drawn parts at the limit values. Furthermore, the margin or edge is formed on hardened and preferably polished tool geometries, so that micro notching is reduced and higher (smoother and more defined) stresses are made possible.

Furthermore, the specific adjustment of the deformed forming region or the concentrated thickening at the margin or at outer edges makes it possible to increase the stiffness of the structural part produced with the method according to the invention and thus, for example, reduce the length of flanges or to omit them entirely. This can save on structural space and also make possible an especially weight-saving design. Furthermore, with the method according to the invention it is possible partially to avoid the use of shims or the welding of thickening areas at inner edges. Furthermore, it is preferably proposed that the solid-stock forming step or the thickening is carried out either before the formation of the structural part (e.g., on a sheet blank) or before the forming, i.e., in time prior to the forming step, during the formation of the structural part or during the forming, i.e., at a time during the forming step, or after the formation of the structural part or after the forming, i.e., at a time after the forming step.

Further details, features and benefits of the invention will emerge from the drawings, as well as from the following description of preferred embodiments with the aid of the drawings. The drawings only illustrate exemplary embodiments of the invention, not limiting the idea of the invention.

EMBODIMENTS OF THE INVENTION

In the different figures, the same parts are always given the same reference number and therefore as a rule are only named or mentioned once.

Figure 1:
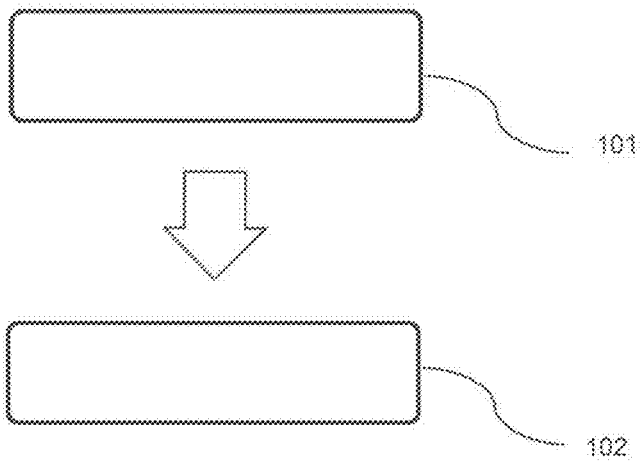
FIG. 1 shows a flow chart according to one exemplary method of the present invention.

FIG. 1 shows a flow chart according to one exemplary method of the present invention. For example, a provision step 101 and a solid-stock forming step 102 are represented. In the method represented in FIG. 1 for the forming of a semi-finished product 1, the semi-finished product 1 is provided in the provision step 101. In the solid-stock forming step 102, a forming region 5 of the semi-finished product 1 is deformed such that a thickness 3 of the deformed forming region 5 increases continuously toward one margin 7 of the semi-finished product 1.

In addition to the method steps shown in FIG. 1, further method steps are provided, for example. For example, in addition the semi-finished product 1 is secured in a fixation step. Moreover, for example, it is also proposed that the semi-finished product 1 is formed in a forming step.

Figure 8:
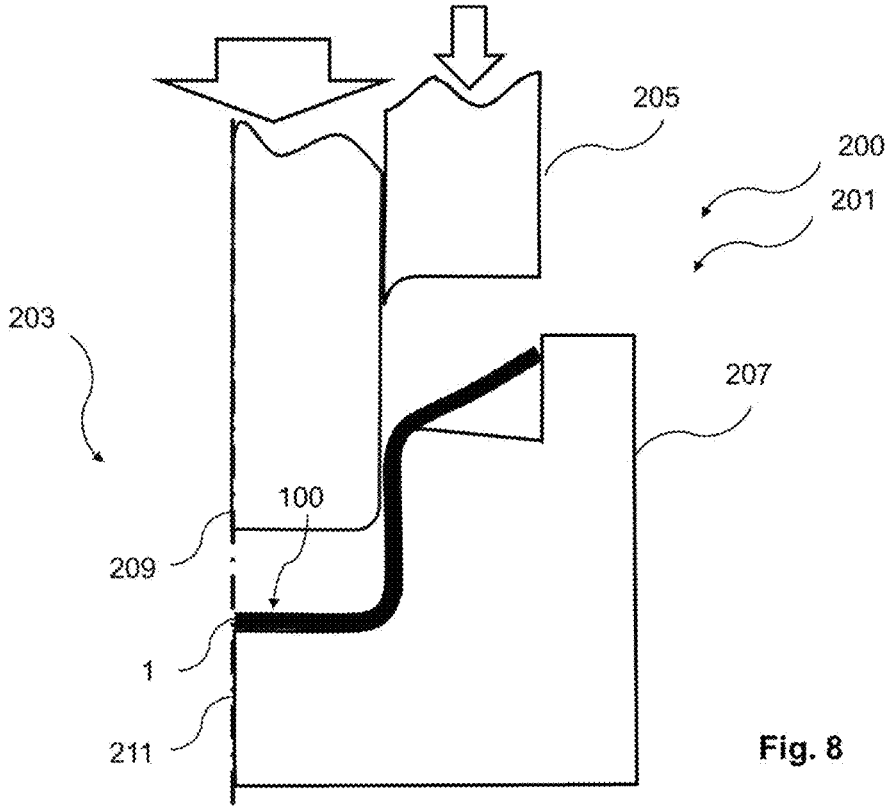
FIG. 8 to FIG. 10 show schematic views according to another sample embodiment and their production of the further subject matter of the present invention.
Figure 9:
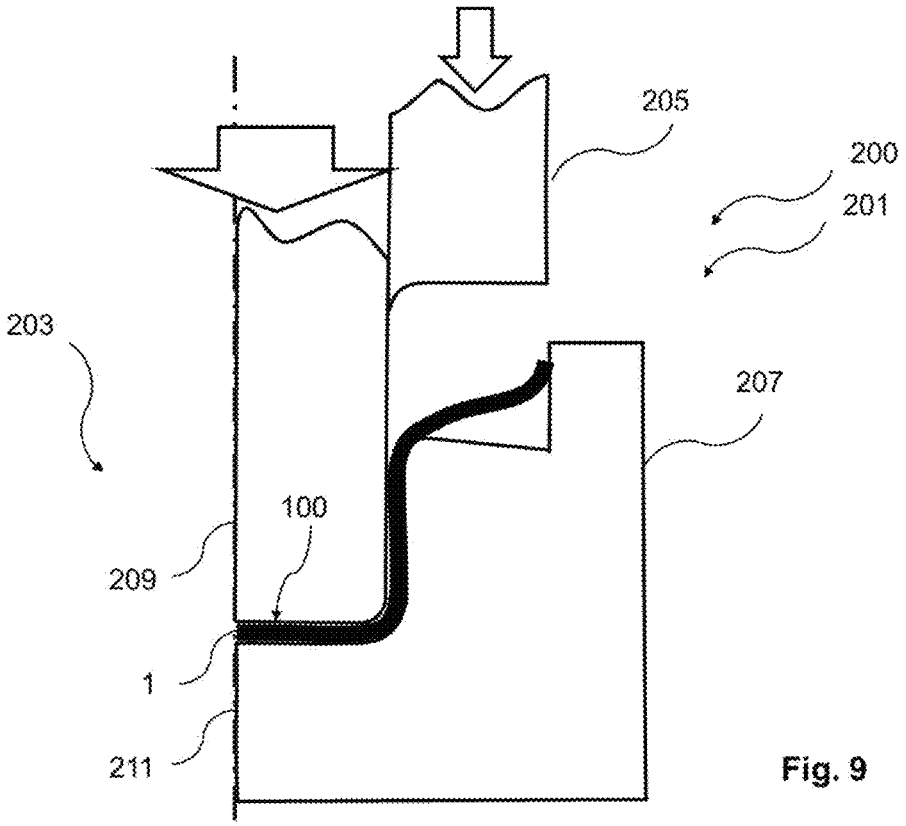
Figure 10:
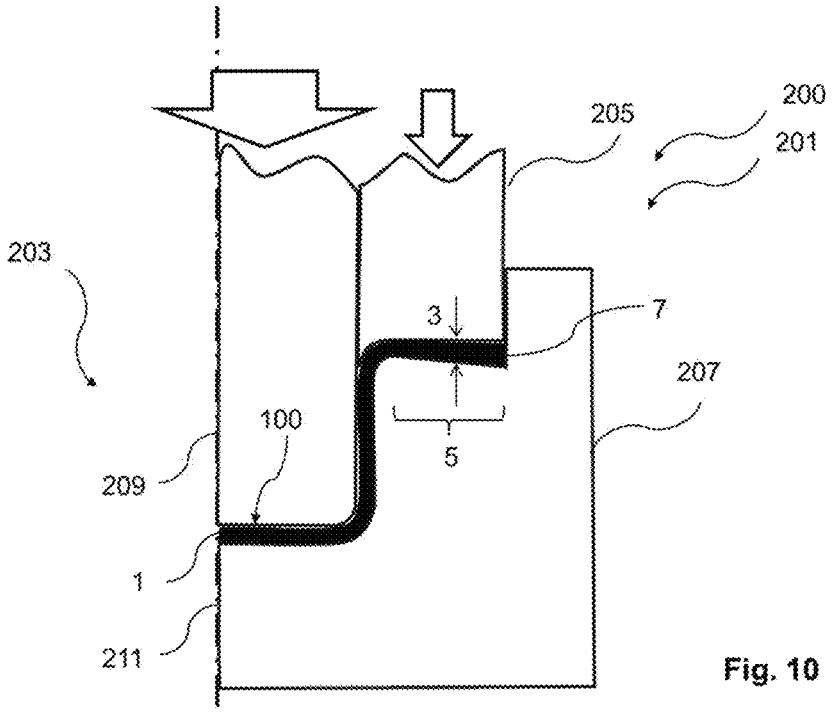

FIG. 2 to FIG. 7 show schematic views according to one sample embodiment and procedure of another subject matter of the present invention. Furthermore, FIG. 8 to FIG. 10 show a further sample embodiment and procedure, FIG. 11 to FIG. 13 a third sample embodiment and procedure, FIG. 14 to FIG. 19 a fourth sample embodiment and procedure, FIG. 20 to FIG. 24 a fifth sample embodiment and procedure and FIG. 25 to FIG. 31 a sixth sample embodiment and procedure of another subject matter of the present invention.

In FIG. 2 to FIG. 31, sample embodiments and procedures of a device 200 for forming a semi-finished product 1 are represented, where the device 200 comprises a molding tool 201 and a fixation tool 203, preferably a hold-down device. The molding tool 201 here is designed such that, for example, the forming region 5 of the semi-finished product 1 can be deformed such that a thickness 3 of the deformed forming region 5 increases continuously toward one margin 7 of the semi-finished product 1. Preferably, the semi-finished product 1 comprises a principal plane of extension 100, the principal plane of extension 100 in the provided semi-finished product 1, as represented for example in FIG. 2, comprising a principal surface of extension or a principal face of extension. Furthermore, it is preferably provided that the principal surface of extension of the formed and deformed semi-finished product 1 is situated at least partly outside of the principal plane of extension 100. Preferably, it is provided that the principal surface of extension runs along a surface of the formed and deformed semi-finished product 1.

According to the invention, preferably the molding tool 201 comprises a first molding tool punch 205 and a second molding tool punch 207. The first molding tool punch 205 and the second molding tool punch 207 here are designed so as to move against each other. Furthermore, the first molding tool punch 205 and the second molding tool punch 207 are designed so that the formed forming region 5 can be received at least partly by the first molding tool punch 205 and the second molding tool punch 207.

For example, it is provided according to the invention that the fixation tool 203 is designed so that the semi-finished product 1 can be secured. The fixation tool 203 here preferably comprises a first fixation tool punch 209 and a second fixation tool punch 211. The first fixation tool punch 209 and the second fixation tool punch 211 are designed so as to move against each other. Furthermore, the first fixation tool punch 209 and the second fixation tool punch 211 are designed so that the semi-finished product 1 can be received at least partly between the first fixation tool punch 209 and a second fixation tool punch 211.

Figure 2:
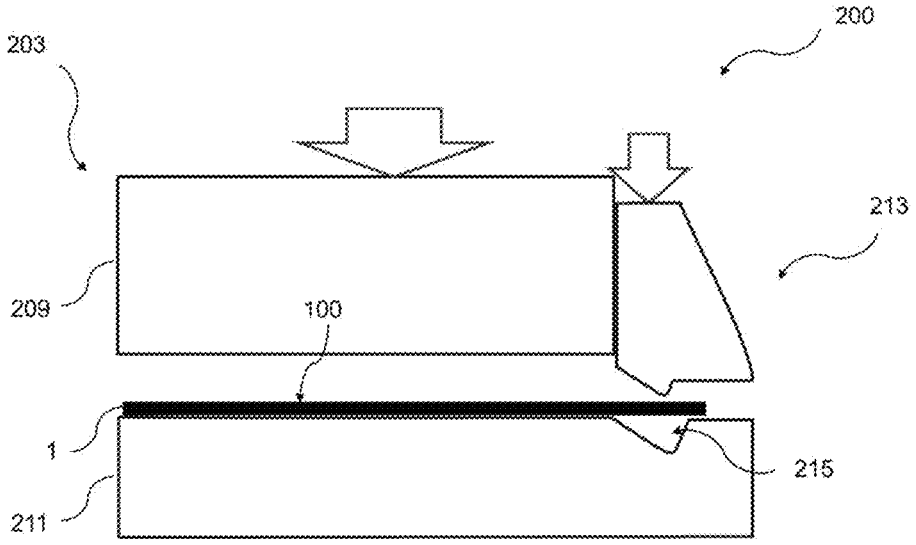
FIG. 2 to FIG. 7 show schematic views according to one sample embodiment and their production of another subject matter of the present invention.

In the following, a method according to the invention shall be described as an example with the aid of FIG. 2 to FIG. 7. FIG. 2 to FIG. 7 show as an example the moments in time of a method for the configuring of thickened outer edges on a sheet blank. FIG. 2 shows the provision step 101, wherein the semi-finished product 1, preferably a sheet blank, is provided. The semi-finished product 1 here is placed in the fixation tool 203 or in a seat of the fixation tool 203 or on the second fixation tool punch 211. The second fixation tool punch 211 or the seat here comprises a recess 215, preferably in the form of a notch.

Figure 3:
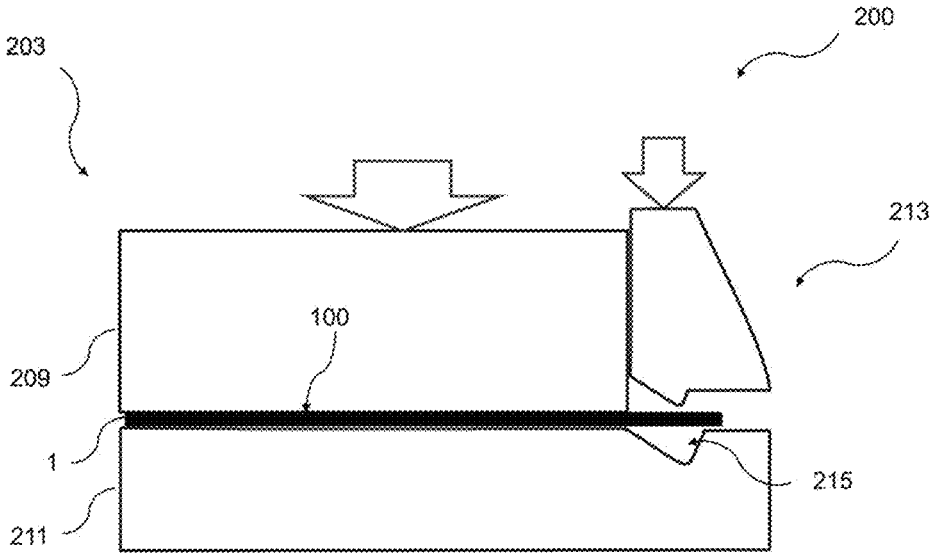

FIG. 3 shows the device 200 including the semi-finished product 1 after the fixation step, where the semi-finished product 1 represented in FIG. 3 is arranged securely in the device 200. For this, the first fixation tool punch 209 was moved in the direction of the second fixation tool punch 211 in the fixation step. In other words, in the fixation step the fixation tool 203 is closed such that the semi-finished product 1 is secured only by a fixation region of the semi-finished product 1, while the forming region 5 is not secured. In other words, a tapering region of the semi-finished product 1 is not covered in the fixation step.

Figure 4:
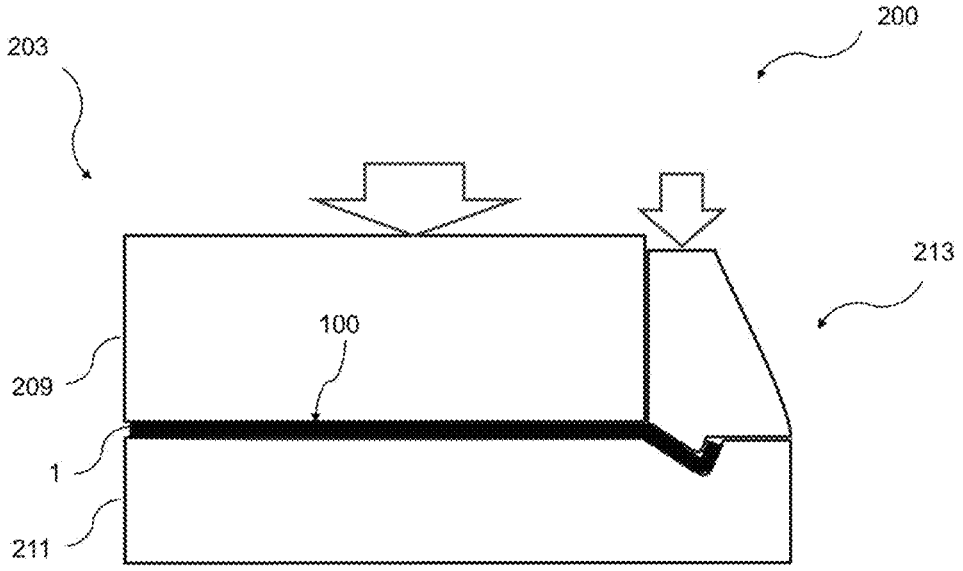

FIG. 4 shows the device 200 including the semi-finished product 1 after the forming step, where the semi-finished product 1 represented in FIG. 4 is formed with the aid of the device 200. For this, the device 200 comprises a forming tool 213 for forming the semi-finished product 1, preferably the forming region 5 of the semi-finished product 1, the forming tool 213 comprising a forming tool punch. For example, the forming tool punch is designed to move with respect to the second fixation tool punch 211. Furthermore, the forming tool punch is preferably designed as a V-punch. Especially preferably, in the forming step the forming tool punch is moved in the direction of the second fixation tool punch 211 and in the direction of the recess 215, so that a preliminary beveling is done with an edging or a rounding off of the semi-finished product 1.

Figure 5:
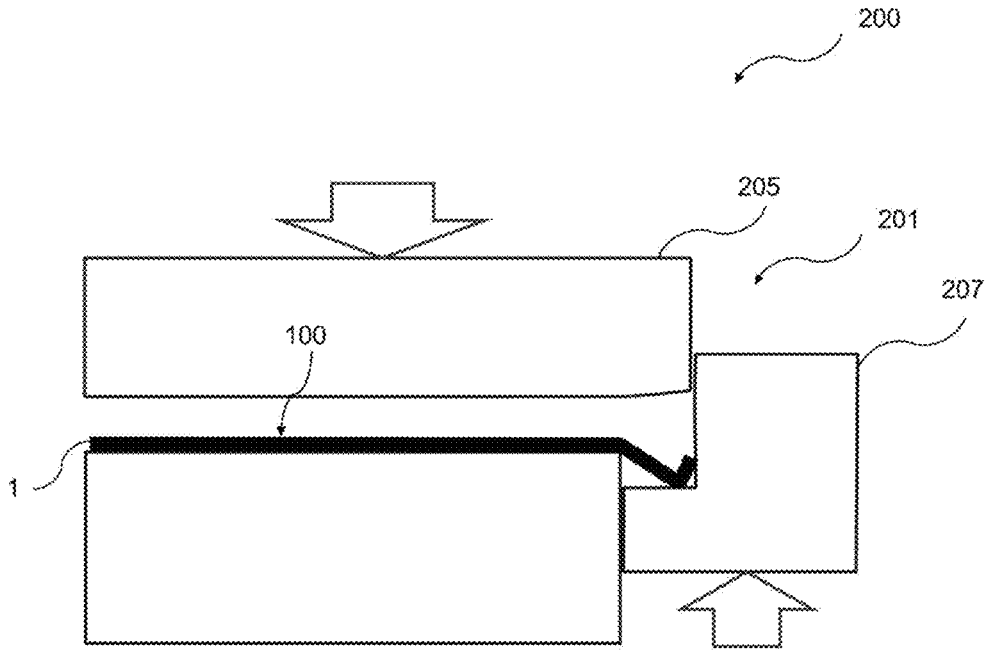

For example, it is provided that the semi-finished product 1 formed in the forming step is removed from a first device unit of the device 200 represented in FIG. 4 and placed into a second device unit of the device 200 represented in FIG. 5. As shown in FIG. 5, the formed semi-finished product 1 or the tapered or beveled sheet blank rests against a base of the molding tool 201. The forming region 5 here projects beyond the base of the molding tool 201 in the direction of the second molding tool punch 207. In other words, the tapered or beveled sheet blank rests by an edge freely on the base of the molding tool 201.

Next, for example in another fixation step, the semi-finished product 1 is secured between the first molding tool punch 205 and the base of the molding tool 201.

Figure 6:
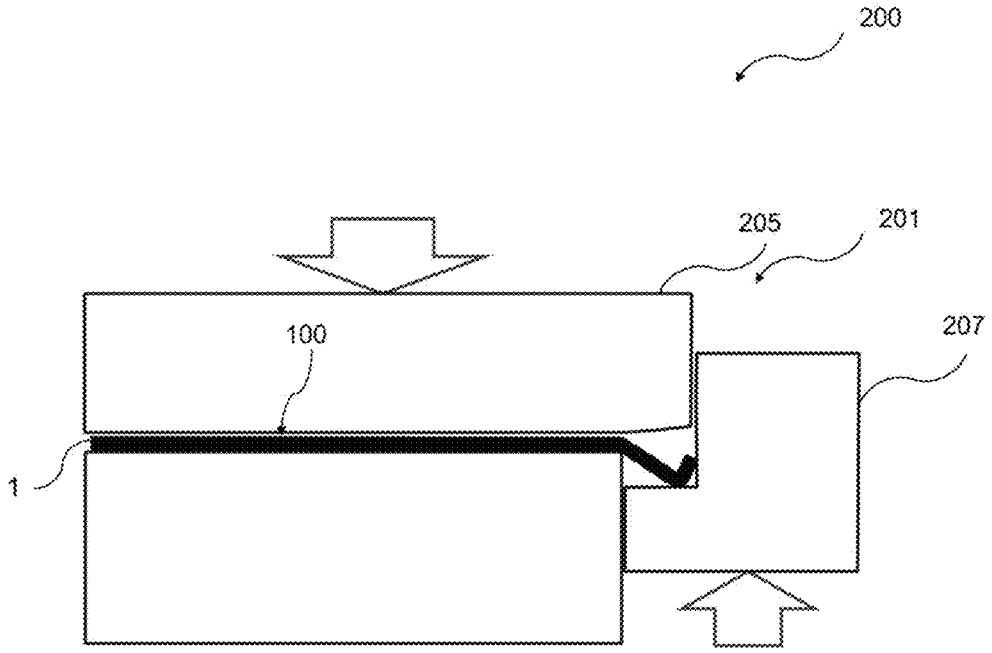

FIG. 6 shows the device 200 or the second device unit of the device 200 including the formed semi-finished product 1 after a new fixation step. As represented in FIG. 6, the first molding tool punch 205, preferably at least in part another hold-down device, firmly holds the non-formed region or the rest of the region of the semi-finished product 1 in flat manner.

Figure 7:
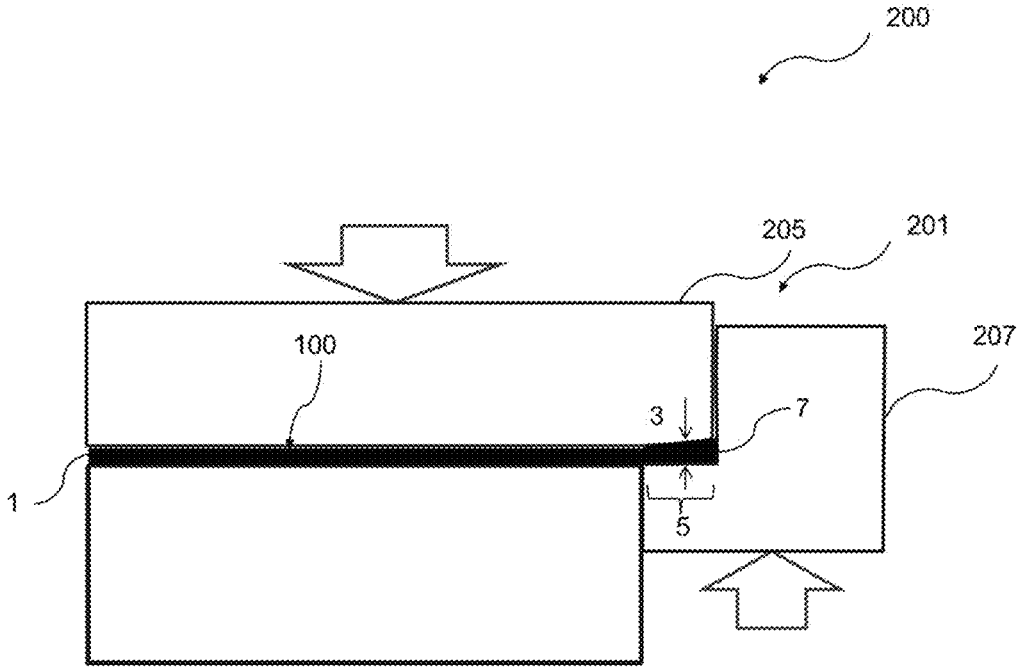

Finally, FIG. 7 shows the device 200 including the semi-finished product 1 after the solid-stock forming step 102. Preferably, for the deforming of the forming region 5 of the semi-finished product 1, the second molding tool punch 207, preferably an edge forming punch, is moved in the direction of the first molding tool punch 205. In this way, as shown in FIG. 7 for example, the formed forming region 5 or the pre-bent region of the semi-finished product 1 is deformed or bent in the direction of the first molding tool punch 205 and a deformed forming region 5 or a thickening is created by plastic deformation or by material flow.

A thickening of the semi-finished product 1 or the sheet blank is advantageously possible in this case, since the semi-finished product 1 is pressed by the first molding tool punch 205 against the base of the molding tool 201 such that the semi-finished product 1 cannot slip during the solid-stock forming step 102.

As represented for example in FIG. 6 and FIG. 7, the length of the principal surface of extension of the formed semi-finished product 1 as represented in FIG. 6 is longer in the plane of the drawing than the spatial extension of the deformed forming region 5 as represented in FIG. 7. In other words, the tapering or beveling of the sheet blank is longer than the thickened region. In this way, the excess material flows into the thickness 3. It is characteristic of the thickening that the thickness 3 is greatest at the outer edge and diminishes toward the interior of the sheet blank.

For example, it is provided according to the invention that the device 200 is designed as a combination tool and comprises the first device unit and the second device unit. Hence, it is advantageously possible for the thickening to be done in a combination tool. Moreover, it is preferably provided that the method according to the invention is done in a device 200 or in a tool together with a semi-finished product trimming or sheet blank trimming (but for the beveling in a different place). Preferably, it is provided that the semi-finished product trimming is done on a side of the semi-finished product 1 facing away from the margin 7.

In the following, a method according to the invention shall be described as an example with the aid of FIG. 8 to FIG. 10. FIG. 8 to FIG. 10 show as an example the moments of time of a method for the configuring of thickened outer edges of a nearly finished structural part with a flange. FIG. 8 shows the provision step 101, during which the semi-finished product 1, preferably a nearly finished structural part, is provided. The semi-finished product 1 here comprises an already trimmed and/or formed flange. As shown for example in FIG. 8, the flange is configured in a first region at least partly substantially perpendicular to the principal plane of extension 100 and in a second region at least partly substantially away from an orientation of the first region and in the direction of an orientation of the principal plane of extension 100. The device 200 here is configured such that the semi-finished product 1 can be received by the device 200. In other words, the seat of the device 200 has the shape of the deformed semi-finished product 1 or structural part with a region which can receive the deformed forming region 5 or the thickening. In the sample embodiment of the present invention represented in FIG. 8 to FIG. 10, the deforming of the semi-finished product 1 or the thickening of the outer edge of the structural part occurs substantially analogously to the sample embodiment represented in FIG. 2 to FIG. 7. As shown in FIG. 9, the semi-finished product 1 here is clamped between the first fixation tool punch 209 and the second fixation tool punch 211. The flange of the semi-finished product 1 or the beveled portion of the semi-finished product 1 is left free. Next, the first molding tool punch 205, preferably a thickening punch, is moved in the direction of the second molding tool punch 207. In this way, the second region of the flange or the longer, sloping flange as represented in FIG. 10 is forced into the shorter, flat form of a seat of the second molding tool punch 207 and thereby plastically deformed into the deformed forming region 5. in the sample embodiment represented in FIG. 8 to FIG. 10, the second fixation tool punch 211 and the second molding tool punch 207 are shown to be designed as a tool punch. However, it is also provided, for example, that the second fixation tool punch 211 and the second molding tool punch 207 are two tool punches separate from each other.

Figure 11:
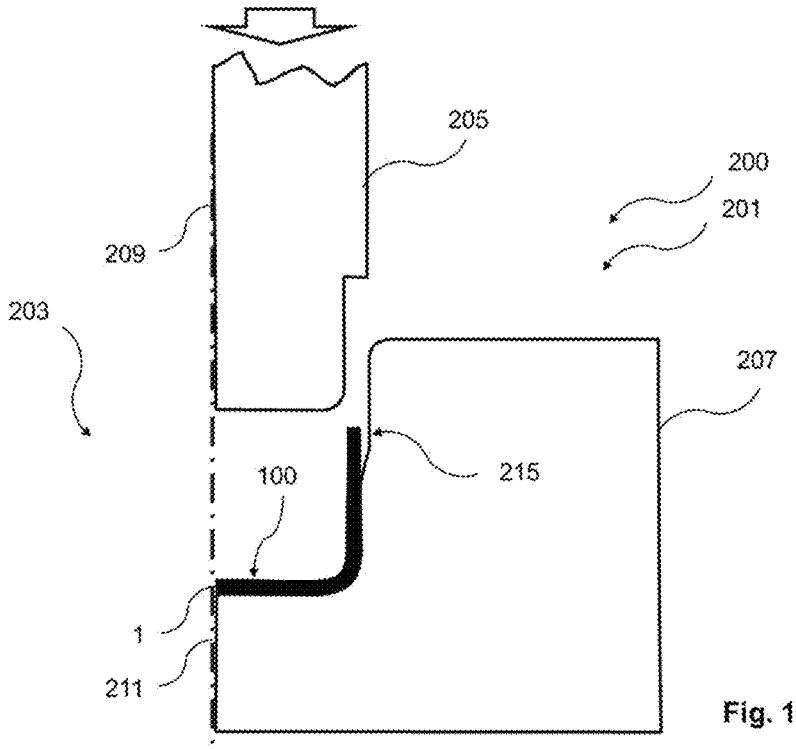
FIG. 11 to FIG. 13 show schematic views according to a third sample embodiment and their production of the further subject matter of the present invention.
Figure 12:
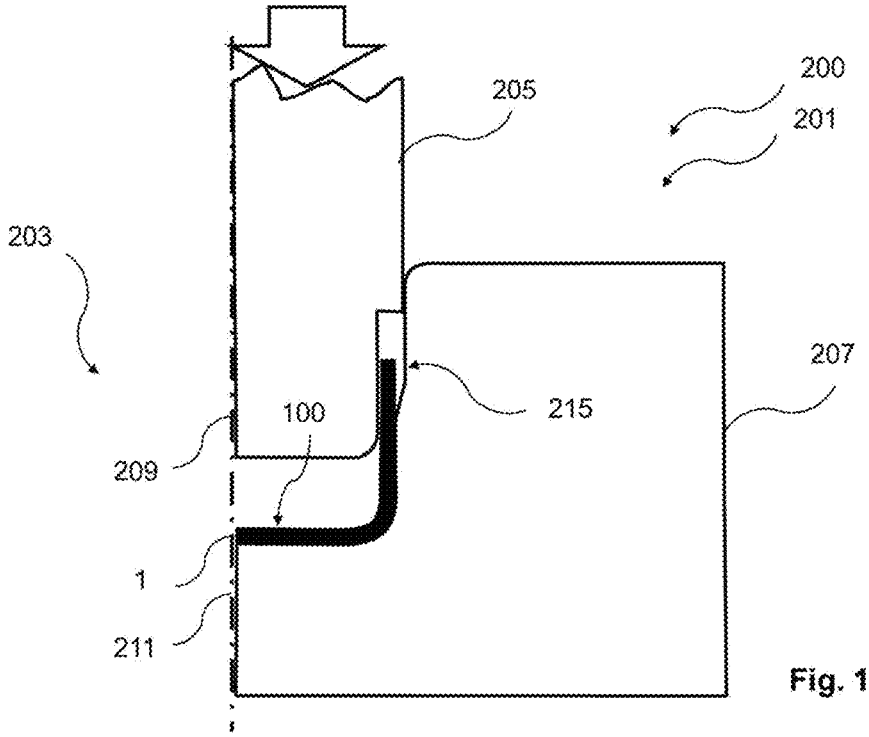
Figure 13:
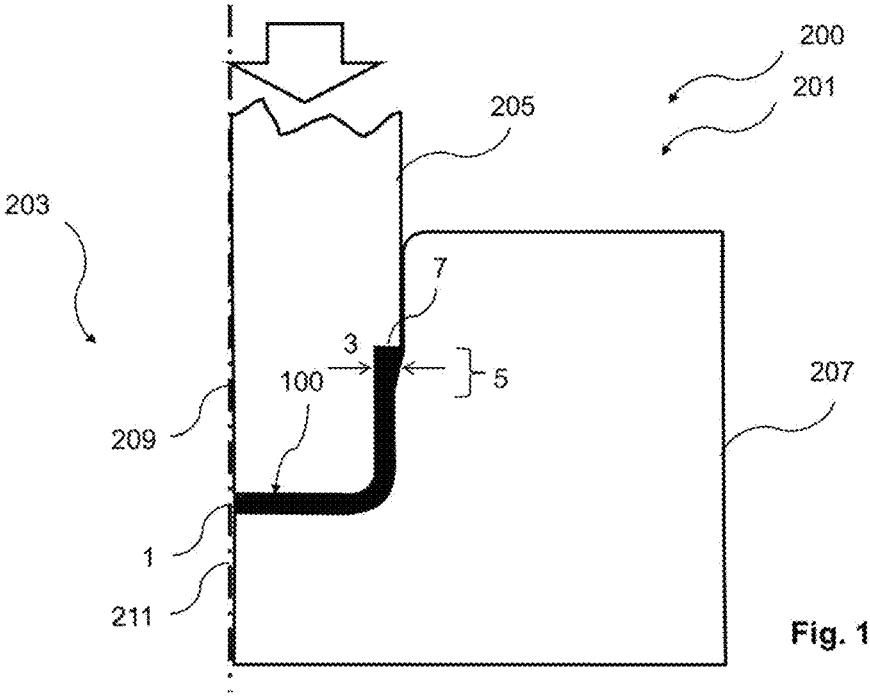

In the following, a method according to the invention shall be described as an example with the aid of FIG. 11 to FIG. 13. FIG. 11 to FIG. 13 show as an example the moments of time of a method for the configuring of thickened outer edges of a nearly finished structural part without flange. The semi-finished product 1, preferably a nearly finished structural part without flange, comprises a frame, wherein the frame is already trimmed and/or shaped. Preferably, the frame here is configured with an excess length, and the excess length is larger than a normal swaging dimension, preferably larger than a swaging dimension used in the prior art. As represented in FIG. 11 to FIG. 13, the device 200 comprises a forging die 207, 211, where the forging die preferably comprises the functions of the second molding tool punch 207 and the second fixation tool punch 211. Furthermore, the device 200 comprises a swaging die 205, 209, wherein the swaging die comprises substantially the functions of the first molding tool punch 205 and the first fixation tool punch 209. The forging die here is designed such that the forging die has substantially the shape of the structural part or the semi-finished product 1. The forging die comprises a frame region to receive the deformed forming region 5 or the thickening after the solid-stock forming step 102. As represented in FIG. 11, the semi-finished product 1 or the structural part is inserted into the forging die 207, 211 in the provision step 101 and then, as represented in FIG. 13, the outer edges of the frame are thickened in the solid-stock forming step 102 with the swaging die 205, 209. In the solid-stock forming step 102, the recess 215 in the device 200 is filled by plastic deformation of the semi-finished product 1. After this, the deformed semi-finished product 1 is removed from the device 200, for example. It is preferably provided that the semi-finished product 1 is secured in the fixation step in parallel with the solid-stock forming step 102 in time.

Figure 14:
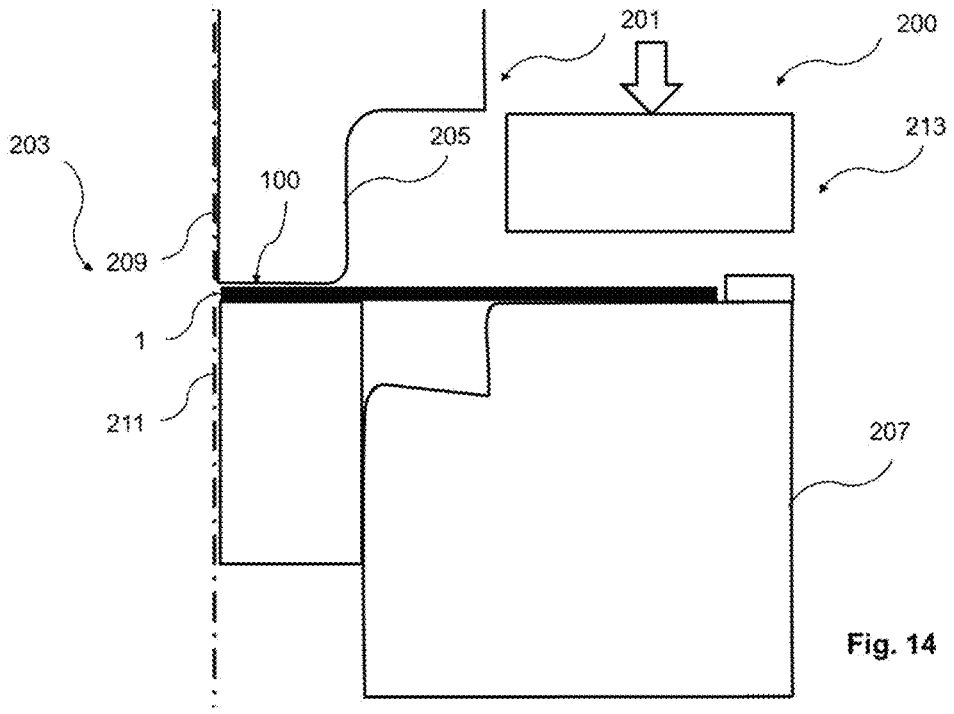
FIG. 14 to FIG. 19 show schematic views according to a fourth sample embodiment and their production of the further subject matter of the present invention.
Figure 15:
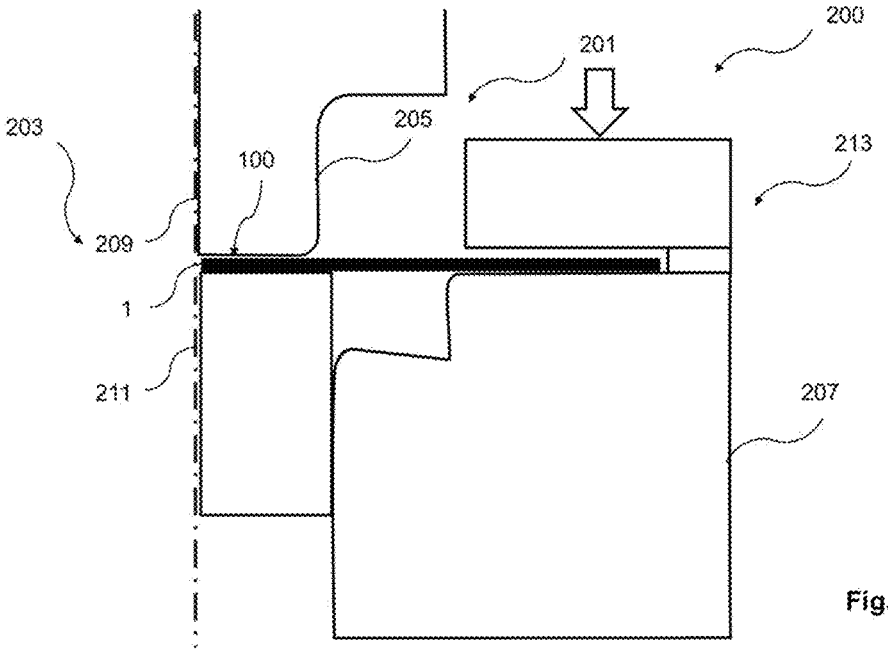
Figure 16:
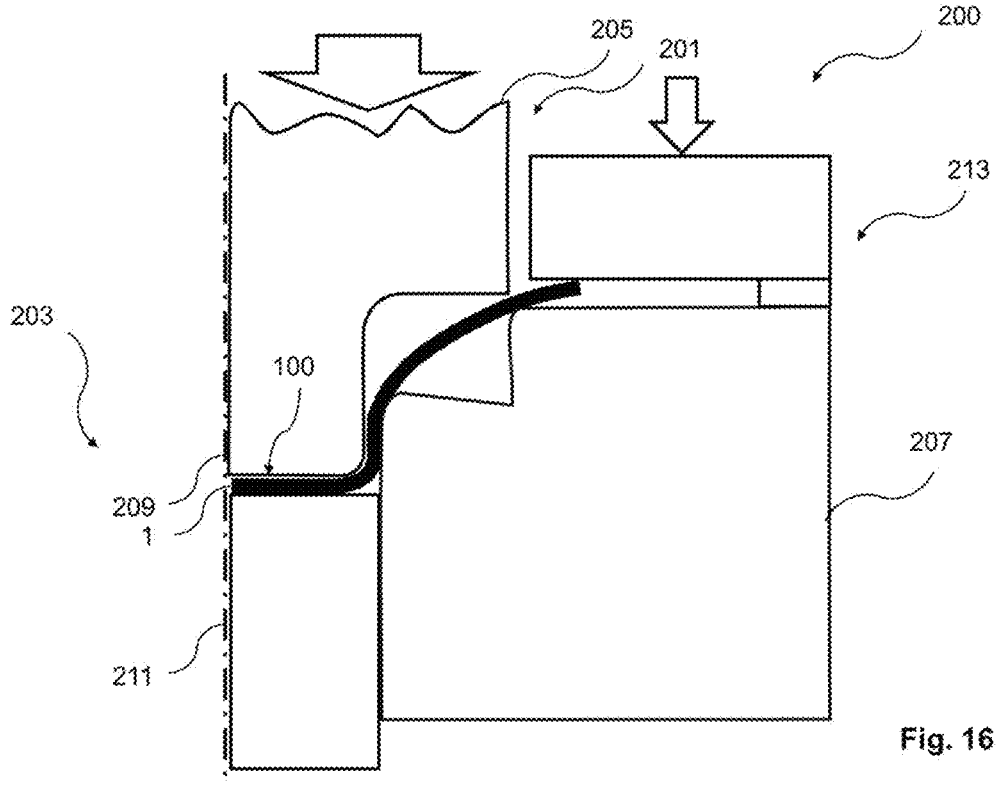
Figure 17:
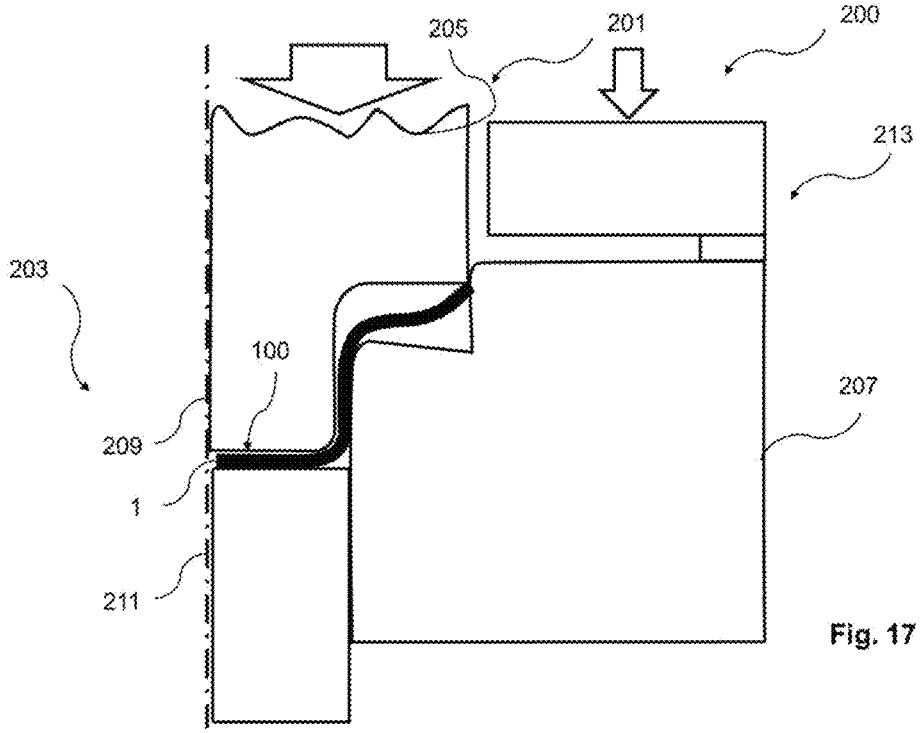
Figure 18:
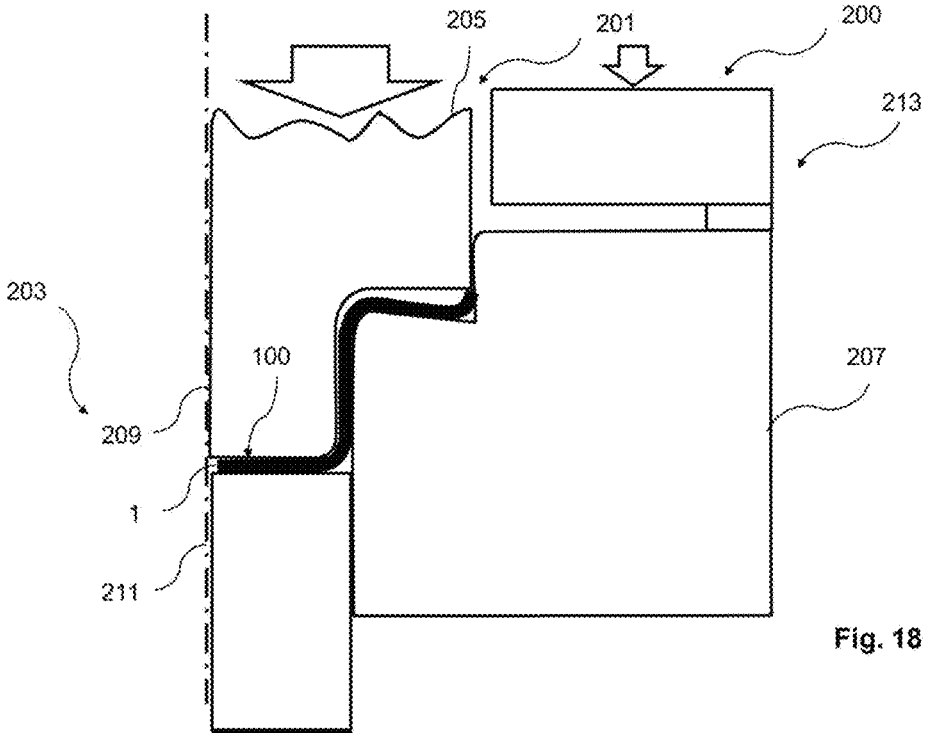
Figure 19:
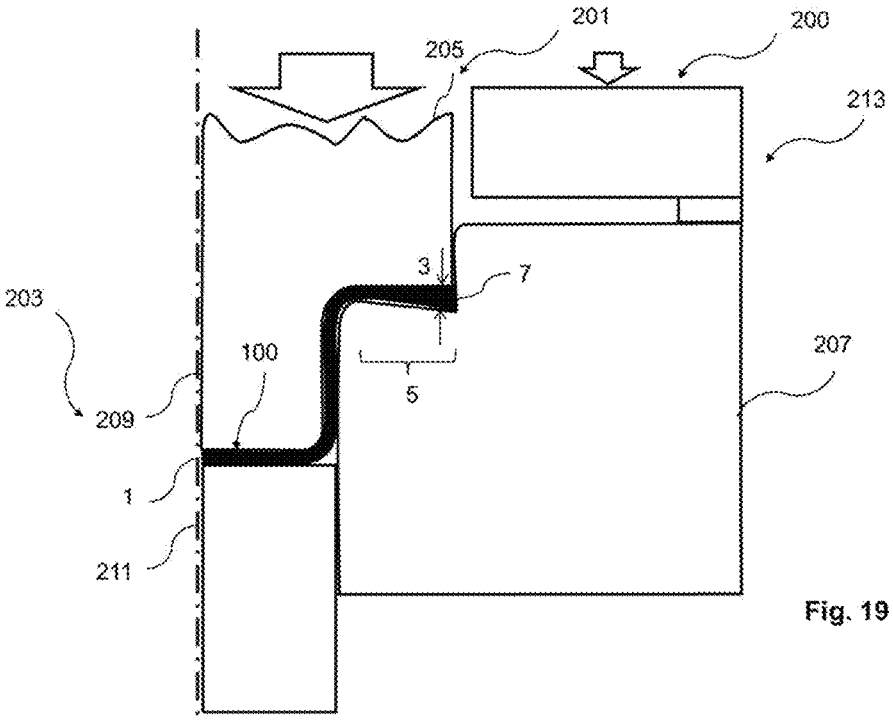

In the following, a method according to the invention shall be described as an example with the aid of FIG. 14 to FIG. 19. FIG. 14 to FIG. 19 show as an example the moments of time of a method for the configuring of thickened outer edges of a structural part with flange during the parts molding. The semi-finished product 1 here, preferably a previously defined minimal shape blank, is provided in the provision step 101, as represented in FIG. 14. At first, the semi-finished product 1 is secured between the first fixation tool punch 209 and the second fixation tool punch 211. The semi-finished product 1 lies at least partly on the second molding tool punch 207. Next, the forming tool 213, preferably a spaced-apart hold-down device, is moved in the direction of the semi-finished product 1 up to a position at a distance from the semi-finished product 1, as represented in FIG. 15. In this way, it is advantageously possible that the freedom of movement of the semi-finished product 1 is limited, but the semi-finished product 1 can move in the region of the forming tool 213 substantially in a direction parallel to the principal plane of extension 100 and in the plane of the drawing. The forming and deforming of the semi-finished product 1 is now possible in relative movement of the first fixation tool punch 209 and the second fixation tool punch 211 to the second molding tool punch 207 as represented in FIG. 16 to FIG. 19. FIG. 18 shows that the device 200 and the semi-finished product 1 are configured such that a flange region of the semi-finished product 1 after the forming comprises a margin region folded in the direction of the first molding tool punch 205. The principal surface of extension of the semi-finished product 1 here is longer in the region of the recess 215 than the one extension of the recess 215 substantially parallel to the principal plane of extension 100. In other words, the flange region of the semi-finished product 1 or the portion of the semi-finished product 1 which provides a flange with folded-over margin region during the shaping shortly before a bottom dead center (of the first fixation tool punch 209 and the second fixation tool punch 211) as represented in FIG. 19 is longer than the room provided for this in the tool. This has the result that the flange is thickened from its edge in the bottom dead center.

Hence, with the sample embodiment represented in FIG. 14 to FIG. 19 it is possible to make a structural part where outer edges of the structural part are thickened and a procedure similar to the method disclosed in publications of the applicant such as DE 10 2007 059 251 A1, DE 10 2008 037 612 B4, DE 10 2009 059 197 A1, DE 10 2013 103 612 A1 and DE 10 2013 103 751 A1 can be carried out. In this way, one may select a structural part with flange with spaced-apart hold-down device or without hold-down device and with raised bottom region.

Figure 20:
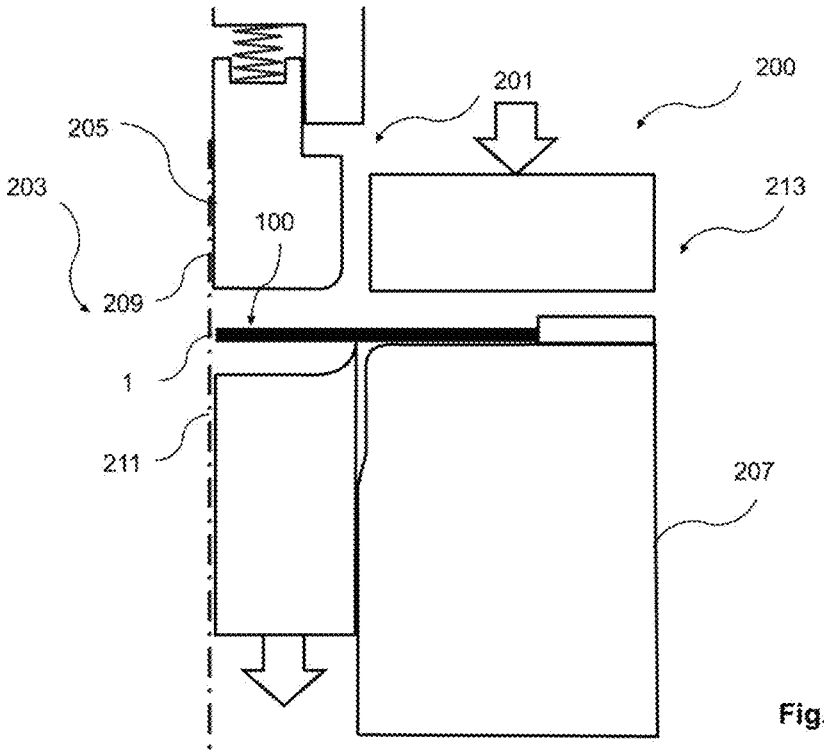
FIG. 20 to FIG. 24 show schematic views according to a fifth sample embodiment and their production of the further subject matter of the present invention.
Figure 21:
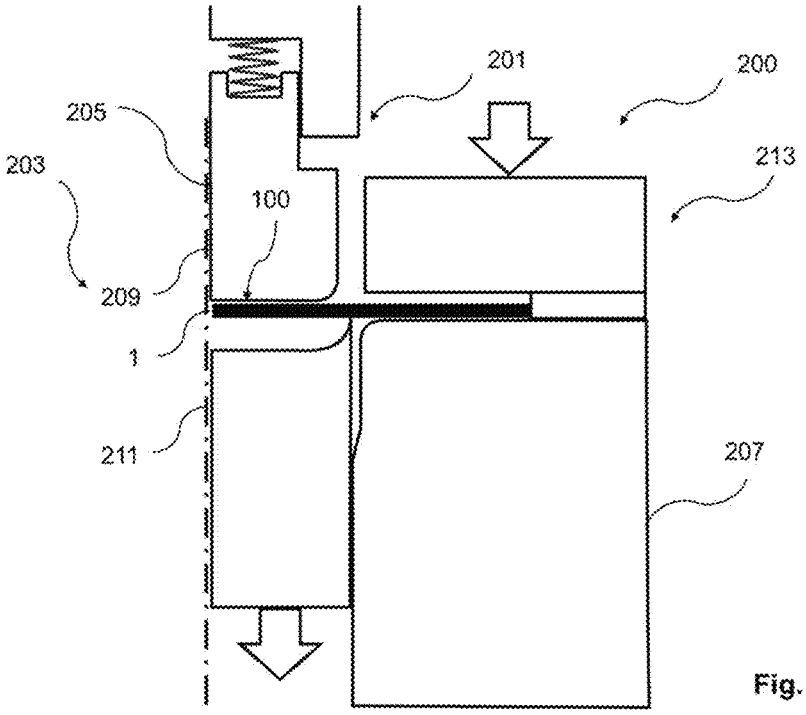
Figure 22:
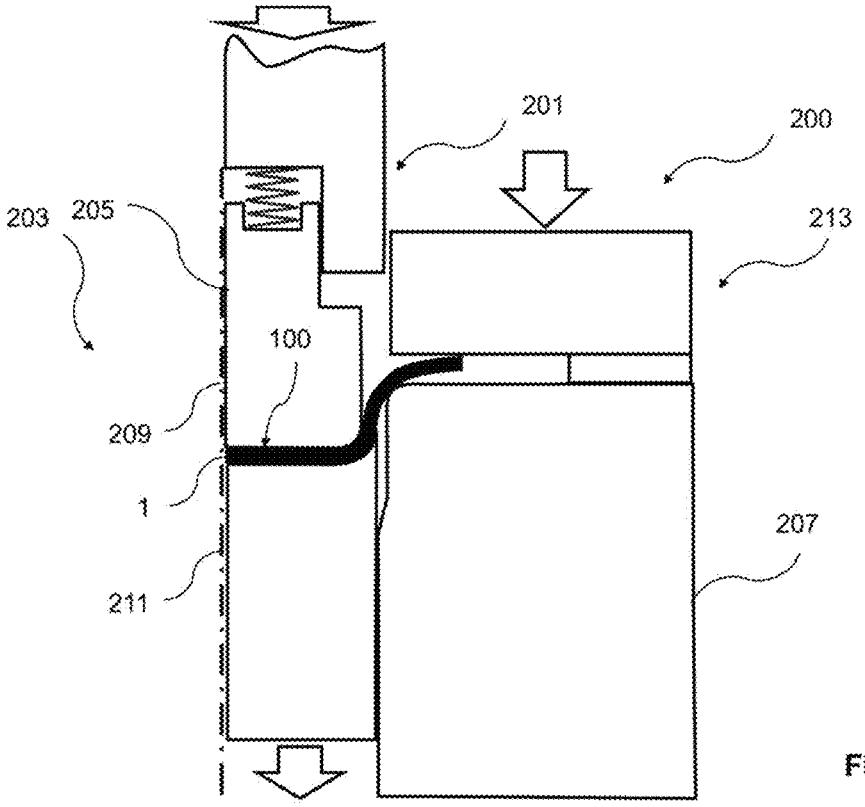
Figure 23:
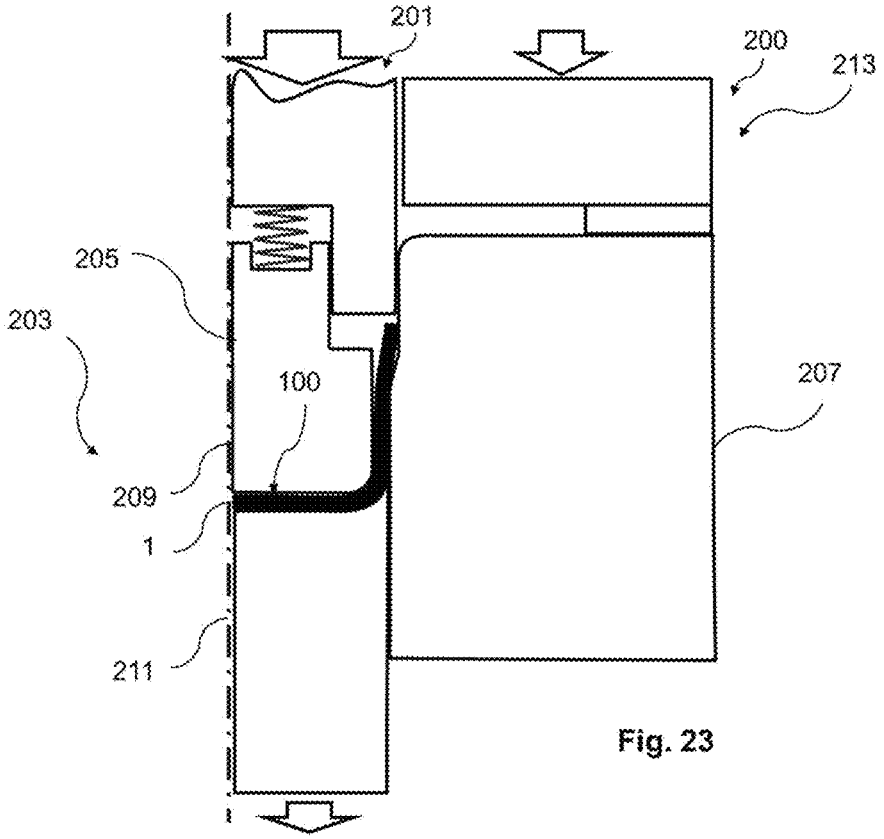
Figure 24:
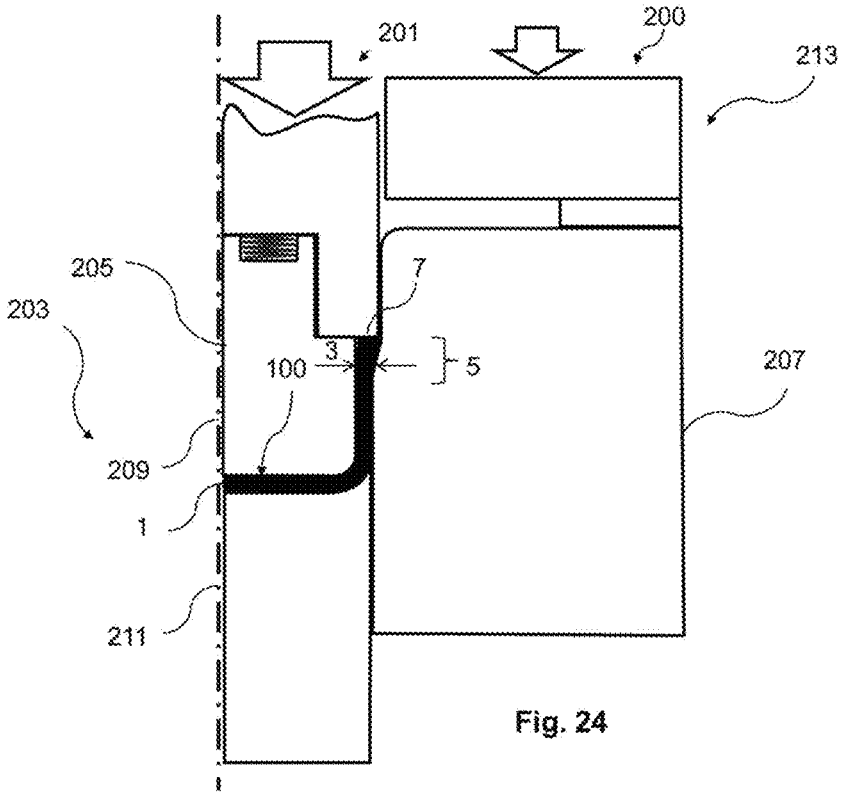

In the following, a method according to the invention shall be described as an example with the aid of FIG. 20 to FIG. 24. FIG. 20 to FIG. 24 show as an example the moments of time of a method for the configuring of thickened outer edges of a structural part without flange during the parts molding. The semi-finished product 1 here, preferably a previously defined minimal shape blank, is provided as represented in FIG. 20 in the provision step 101. In the sample embodiment represented in FIG. 20 to FIG. 24, the device 200 comprises a two-piece first molding tool punch 205, preferably a swaging die. A first partial punch of the first molding tool punch 205 facing toward the semi-finished product 1 in FIG. 20 is connected to a second partial punch of the first molding tool punch 205 facing away from the semi-finished product 1 in FIG. 20 and situated at a distance from each other in FIG. 20. During the forming of the semi-finished product 1 or during the parts molding, the first partial punch and the second partial punch are situated at a distance from each other. The forming of the semi-finished product 1 is now possible, as represented in FIG. 22 to FIG. 23, by relative movement of the first fixation tool punch 209 and the second fixation tool punch 211 to the second molding tool punch 207. In this way, a formed semi-finished product 1 is produced, as shown in FIG. 23, where the formed semi-finished product 1 comprises a flangeless frame or structural part frame, the frame being longer than a frame for a structural part without deformed forming region 5 or thickening. Shortly before the bottom dead center, i.e., at a time between FIG. 23 and FIG. 24, a locking is released and the distance between the first partial punch and the second partial punch is reduced until the first partial punch and the second partial punch touch each other, as shown in FIG. 24. In other words, the distance between the first partial punch and the second partial punch or the two punch pieces is set at zero. The swaging process of the punch, which ends in the bottom dead center, compresses the excess length and thereby thickens the margin region, as shown in FIG. 24. This provides another possibility of thickening outer edges of a structural part without flange during the parts molding or during the forming process. Thus, advantageously, a procedure similar to the method disclosed in publications of the applicant such as DE 10 2007 059 251 A1, DE 10 2008 037 612 B4, DE 10 2009 059 197 A1, DE 10 2013 103 612 A1 and DE 10 2013 103 751 A1 can be chosen without flange thanks to the present invention.

In the following, a method according to the invention shall be described as an example with the aid of FIG. 25 to FIG. 31. FIG. 25 to FIG. 31 show as an example the moments of time of a method for the configuring of thickened inner edges.

Figure 25:
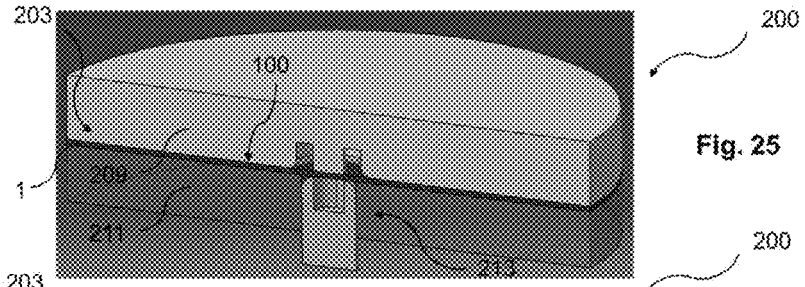
FIG. 25 to FIG. 31 show schematic views according to a sixth sample embodiment and their production of the further subject matter of the present invention.
Figure 26:
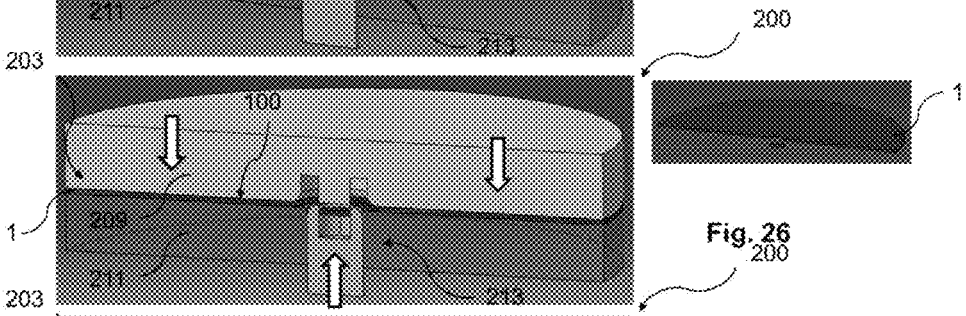

FIG. 25 shows as an example that the semi-finished product 1, preferably a sheet blank, is provided and secured between the first fixation tool punch 209 and the second fixation tool punch 211. After this, the semi-finished product 1 as shown in FIG. 26 is formed and perforated at least partly at the same time. Next, the semi-finished product 1 is further formed at a time after the perforation. This is shown for example in FIG. 27. The perforation is widened to form a collar or a deep depression. The clear dimension of the widening determines the size of the later hole, represented in FIG. 31.

Figure 29:
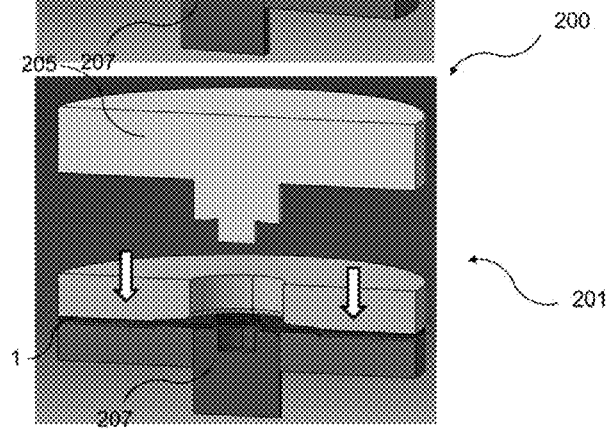
Figure 30:
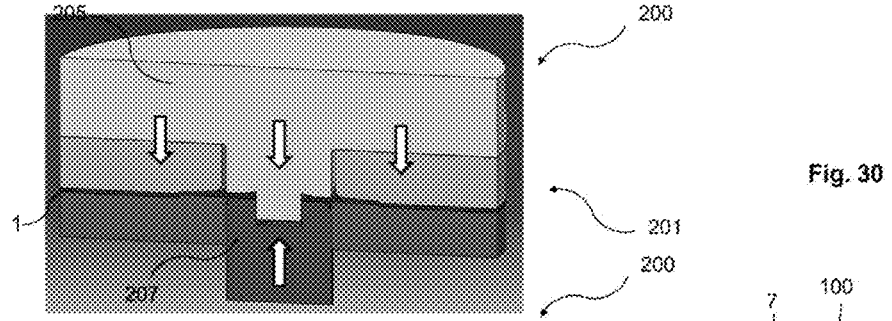
Figure 31:
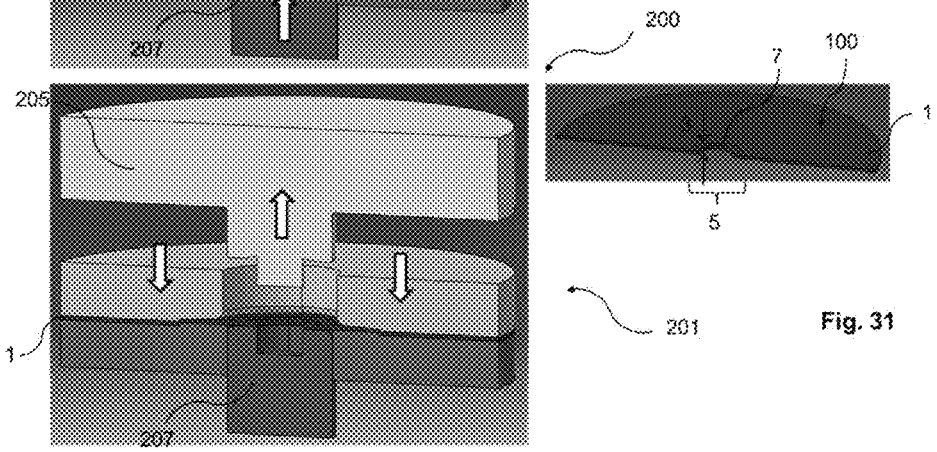

Finally, the formed semi-finished product 1 represented in FIG. 28 to FIG. 31 is deformed. First of all, as represented in FIG. 29, the formed semi-finished product 1 is secured and then, as shown in FIG. 30, it is deformed with the aid of the first molding tool punch 205, preferably a swaging die, and the second molding tool punch 207. In other words, FIG. 29 shows that a swaging die compresses the collar or the depression so that a thickened region is produced with a desired opening dimension.

Figure 27:
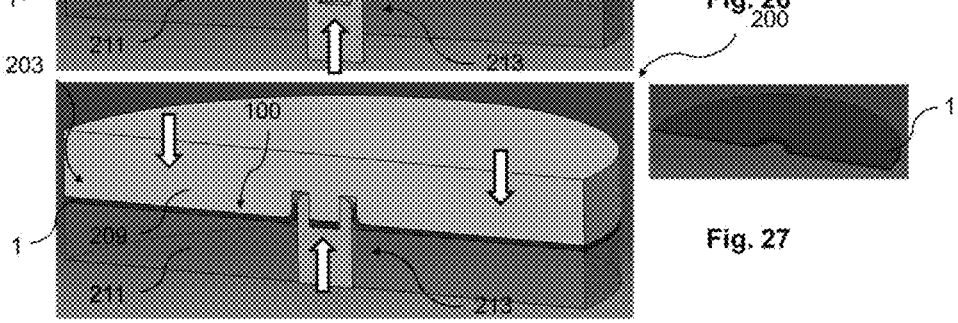
Figure 28:
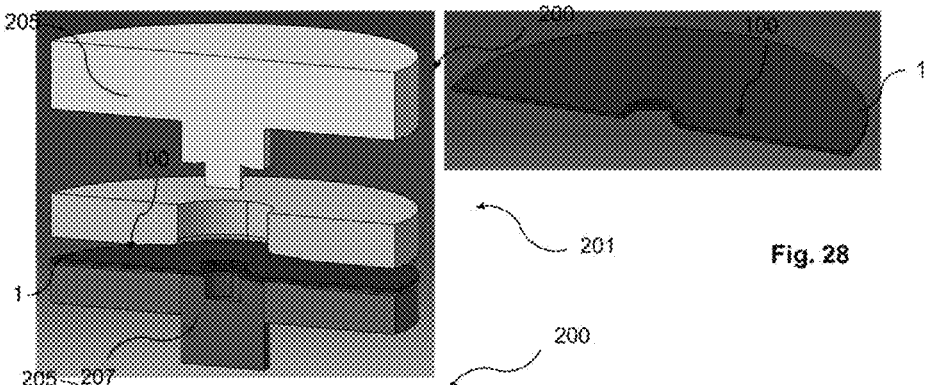

FIG. 25 to FIG. 31 show that the method according to the invention is carried out in two steps. Here, FIG. 25 to FIG. 27 show a first device unit of the device 200 and FIG. 28 to FIG. 31 show a second device unit of the device 200. In other words, the method is carried out in two steps, each time with a combination tool for the perforation and collar forming and with a tool for the collar swaging. According to one sample embodiment, however, it is also provided that the perforation of the semi-finished product 1 is done in a third device unit of the device 200, the forming of the semi-finished product 1 is done in a fourth device unit of the device 200, and the deforming of the semi-finished product 1 is done in a fifth device unit of the device 200. In other words, it is provided for example that each operation is done in an individual tool. Furthermore, it is preferably provided that the device 200 is incorporated in a complex, press-bound tool. It is preferably provided in this case that the method according to the invention is carried out in the complex, press-bound tool, while further deforming steps are carried out with the complex, press-bound tool for the further deforming of the semi-finished product 1.

LIST OF REFERENCE NUMBERS

1 Semi-finished product
3 Thickness
5 Forming region
7 Margin
100 Principal plane of extension
101 Provision step
102 Solid-stock forming step
200 Device
201 Molding tool
203 Fixation tool
205 First molding tool punch
207 Second molding tool punch
209 First fixation tool punch
211 Second fixation tool punch
213 Forming tool
215 Recess

The invention claimed is:

1. A method for forming a product, comprising:

providing a blank to form the product in a provision step;

forming the blank in a forming step via a forming tool punch, wherein a thickness of the formed blank is substantially constant, and wherein the forming step creates a bend in the blank in a forming region of the blank; and forming the forming region of the blank in a solid-stock forming step via an edge forming punch different than the forming tool punch by moving the edge forming punch in a direction towards the forming tool punch, wherein, during the solid stock forming step, the forming region of the blank is formed such that a thickness of a deformed forming region increases continuously and tapers in increasing thickness toward one margin of the product, and wherein the forming step is carried out after the provision step, while the solid-stock forming step is carried out after the forming step.

2. The method as claimed in claim 1, wherein the blank is secured in a fixation step prior to the forming step.

3. The method as claimed in claim 2, wherein the fixation step is carried out after the provision step, while the solid-stock forming step is carried out after the fixation step.

4. The method as claimed in claim 2, wherein the solid-stock forming step and the fixation step are carried out at the same time.

5. The method as claimed in claim 1, wherein the blank is secured in a fixation step, and wherein the forming step is carried out after the fixation step, while the solid-stock forming step is carried out after the forming step.

6. The method as claimed in claim 5, wherein the fixation step and the forming step are carried out at the same time.

7. A device for forming a product comprising a molding tool, the molding tool comprising:

a forming tool punch; and an edge forming punch, wherein the molding tool is adapted to:

form a blank with the forming tool punch, wherein a thickness of the formed blank is substantially constant, and wherein forming the blank creates a bend in the blank in a forming region of the blank; and deform the blank forming the product with the edge forming tool, by moving the edge forming punch in a direction towards the forming tool punch, to form the forming region of the blank such that a thickness of the deformed forming region increases continuously and tapers in increasing thickness toward one margin of the product, wherein the molding tool is adapted to deform the blank to form the forming region after the forming step.

8. The device as claimed in claim 7, wherein the device comprises a fixation tool, wherein the fixation tool is adapted to secure the blank.

9. The method as claimed in claim 1, wherein the blank is provided in a semi-finished state of the product.

10. The device as claimed in claim 7, wherein the blank is provided in a semi-finished state of the product.

* * * * *